US008242345B2

(12) United States Patent
Elion

(10) Patent No.: US 8,242,345 B2
(45) Date of Patent: Aug. 14, 2012

(54) ELECTRONIC FINGERBOARD FOR STRINGED INSTRUMENT

(76) Inventor: Clifford S. Elion, Chatsworth, CA (US)

( * ) Notice: Subject to any disclaimer, the term of this patent is extended or adjusted under 35 U.S.C. 154(b) by 60 days.

(21) Appl. No.: 12/655,719

(22) Filed: Jan. 6, 2010

(65) Prior Publication Data

US 2011/0011248 A1 Jan. 20, 2011

Related U.S. Application Data

(63) Continuation-in-part of application No. 12/383,750, filed on Mar. 27, 2009, now abandoned, which is a continuation-in-part of application No. 12/284,953, filed on Sep. 26, 2008, now Pat. No. 8,003,877.

(60) Provisional application No. 60/976,413, filed on Sep. 29, 2007, provisional application No. 61/011,259, filed on Jan. 16, 2008, provisional application No. 61/145,735, filed on Jan. 19, 2009, provisional application No. 61/149,696, filed on Feb. 3, 2009.

(51) Int. Cl.
*G10H 1/18* (2006.01)
*G10H 1/34* (2006.01)
*G10H 3/00* (2006.01)

(52) U.S. Cl. ..... 84/646; 84/720; 84/745

(58) Field of Classification Search ..... 84/646, 84/720, 745

See application file for complete search history.

(56) References Cited

U.S. PATENT DOCUMENTS

| | | | | | |
|---|---|---|---|---|---|
| 3,694,559 | A | * | 9/1972 | Suzuki et al. | 84/744 |
| 3,742,114 | A | | 6/1973 | Barkan | |
| 3,960,044 | A | * | 6/1976 | Nagai et al. | 84/719 |
| 4,580,479 | A | | 4/1986 | Bonanno | |
| 4,630,520 | A | | 12/1986 | Bonanno | |
| 4,658,690 | A | | 4/1987 | Aitken et al. | |
| 4,858,509 | A | | 8/1989 | Marshall | |
| 5,033,351 | A | * | 7/1991 | Nomura | 84/646 |
| 5,140,887 | A | * | 8/1992 | Chapman | 84/646 |
| 5,396,025 | A | * | 3/1995 | Tamura | 84/736 |
| 5,398,585 | A | * | 3/1995 | Starr | 84/646 |

OTHER PUBLICATIONS

Fletcher & Rossing, "The Physics of Musical Instruments", Springer-Verlang, 1998.

Hal Chamberlin Hayden, "Musical Applications of Microprocessors", 1985.

* cited by examiner

*Primary Examiner* — Jeffrey Donels

(74) *Attorney, Agent, or Firm* — Colin P. Abrahams

(57) ABSTRACT

An electronic fingerboard for use on a musical instrument comprises a printed circuit board layer with contact electrodes and electronic sensing components. A first double sided adhesive tape is formed over the printed circuit board layer, and a polyester film membrane having carbon printing on the lower surface thereof is formed above the first double sided adhesive tape. A second double sided adhesive tape is formed above the polyester film membrane, and a silicon rubber overlay is mounted over the second double sided adhesive layer. A polyurethane overspray comprising a non-stick coating is then formed on the silicon rubber overlay.

5 Claims, 16 Drawing Sheets

FIGURE 25
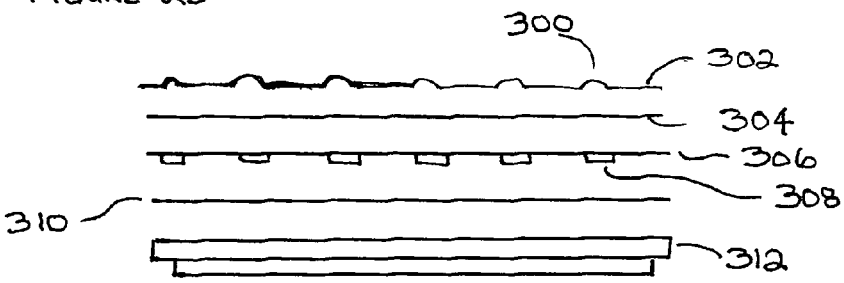
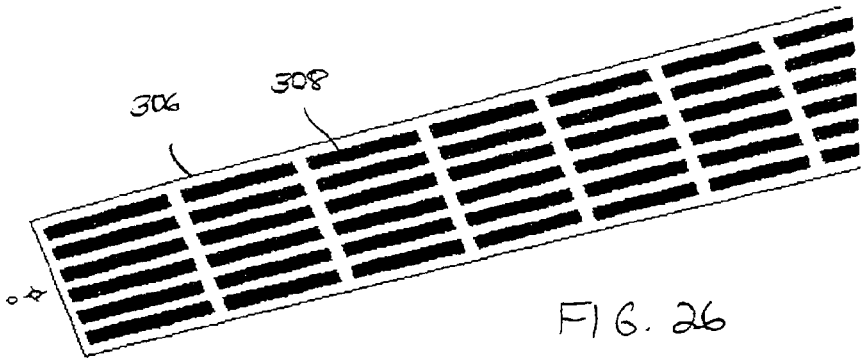
FIG. 26

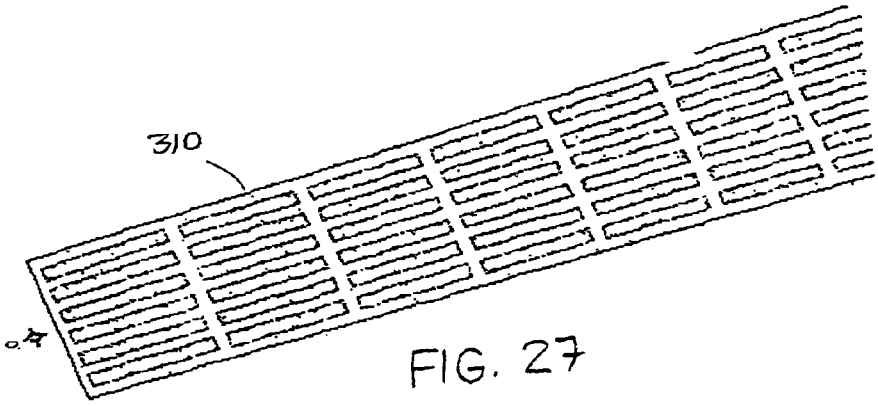
FIG. 27
FIGURE 28
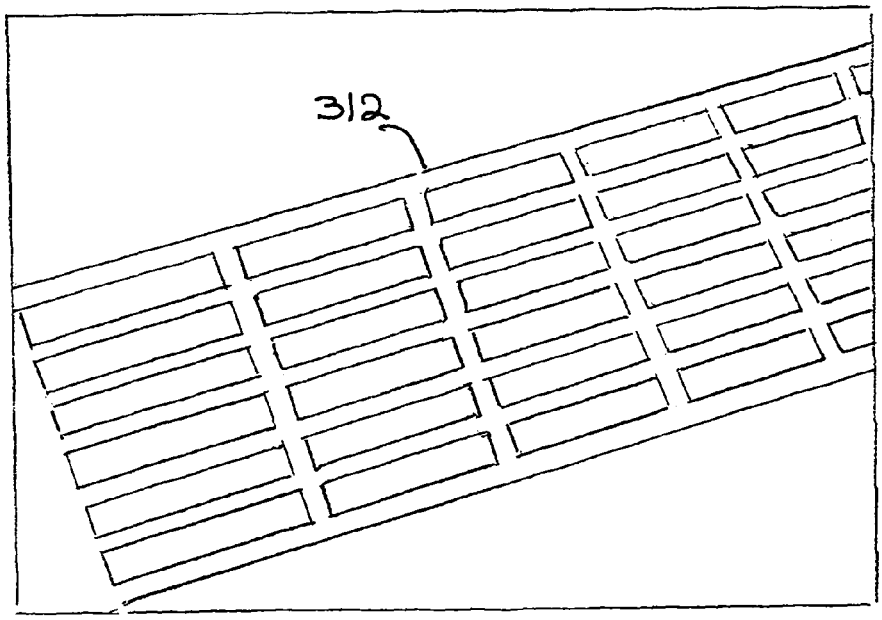

ELECTRONIC FINGERBOARD FOR STRINGED INSTRUMENT

CROSS REFERENCE TO RELATED APPLICATIONS

This application is a continuation in part application of U.S. patent application Ser. No. 12/383,750 filed Mar. 27, 2009, which is a continuation in part application of U.S. patent application Ser. No. 12/284,953 filed Sep. 26, 2008, which claims the benefit of U.S. Provisional Patent Application Nos. 60/976,413 filed Sep. 29, 2007 and 61/011,259 filed Jan. 16, 2008, all of which are incorporated by reference in their entirety. Further, this application claims the benefit U.S. Provisional Patent Application Nos. 61/145,735 filed Jan. 19, 2009 and 61/149,696 filed Feb. 3, 2009, which are incorporated by reference in their entirety.

FIELD AND BACKGROUND OF THE INVENTION

The present invention relates to an interface for controlling musical instrument synthesizers. In one aspect, the present invention allows musicians familiar with stringed instruments to use their musical skill to control electronic music synthesizers.

According to one aspect of the invention, there is provided a synthesizer controller based on a guitar interface, but the invention is not limited to use with guitars and can be utilized in any other stringed instrument form-factor.

A typical stringed instrument has two means for activating and controlling sounds. The first means controls the loudness or onset of the tone, and the second means controls the pitch of the tone. In a conventional mechanical or electro-mechanical stringed instrument, this is accomplished by strumming, plucking or bowing the strings with one hand to provide the onset and loudness. The fingers of the other hand are used to terminate the string length to define the pitch of the note.

Two types of interfaces for electronic stringed instruments are generally known. The first is based on pitch detection using an electromagnetic, piezo-electric or optical pickup coupled to each string. The pickup converts the string vibrations into an electrical signal and a combination of hardware signal conditioning and software algorithms is then used to convert the electronic signal into information that can be transmitted to a music synthesizer. This may typically be a MIDI (Musical Instrument Digital Interface) device. This method, however, is characterized by a physical delay between the time that the string is plucked and the time that the resulting note is generated. The delay is due to the fact that a significant part of the electrical waveform must be analyzed before a result can be calculated and transmitted. In a normal guitar, the low E string is about 82.4 Hz, so a single cycle of this waveform is 12.1 ms. Typical systems need to acquire more than a single cycle before the pitch can be accurately determined, and this can result in delays that are not pleasing to musicians.

The second method is based on a set of switches in the instrument neck combined with a set of triggers. The switches in the neck are used to define the pitch of the note to be played. The triggers are plucked or strummed and are used to activate the onset of the note. The problem with this type of system is that the switches in the neck are not very guitar-like for musicians familiar with conventional guitars as well as being expensive to implement.

SUMMARY OF THE INVENTION

In accordance with one aspect of the invention, there is provided an electronic musical instrument for producing musical notes comprising: an onset signal sensor for sensing the initiation of a note played on the musical instrument; and an electronic fingerboard for determining pitch of the note sensed by the sensor, the electronic fingerboard comprising a first layer of film, a second layer of film and a spacer member between the first and second layers of film, the first and second layers being movable relative to each other between a first inactive position in which the first and second layers are separate from each other along their respective lengths and a second active position in which the first and second layers are in contact with each other at a user selected point along their respective lengths, the pitch being determined by the resistance between the first and second layers at the user selected point.

Preferably, the onset signal sensor comprises a piezo-electric sensor, or an optical sensor.

In one embodiment, the musical instrument is a guitar; the fingerboard is mounted on an elongate neck; frets are formed transversely on the neck; elongate structures corresponding to guitar strings are configured on the neck; and a first layer, second layer and spacer member are formed below each of the elongate structures.

Preferably, the first layer is a conductive strip, and the second layer is a resistive strip. The conductive strip may be comprised of silver ink with carbon overlay for durability and the resistive strip may be comprised of carbon. In one form, the conductive strip is on top, the resistive strip is below the conductive strip and the spacer member is formed therebetween. In one embodiment, the conductive strip is comprised of two electrodes which interlock with each other.

In one aspect, the elongates structures corresponding to guitar strings comprise linear raised ribs on the on the fingerboard. Quantized mode, legato mode, or absolute mode may be utilized to determine the pitch of the note.

Preferably, the user selected point provides a controllable resistance representing pitch of the note according to the location of the point on the fingerboard. The onset signal sensor may be triggered by plucking a string on the musical instrument.

Preferably, a microprocessor is provided for sequentially reading and processing signals from the signal sensor and the electronic fingerboard respectively to determine when a note is played, as well as the volume and pitch of the note. The microprocessor may send data on the note played to a MIDI interface, or to an internal wavetable synthesizer.

Preferably, the first and second layers have a terminal at one end thereof and voltage at the terminal is determined by the user selected point. The voltage at the terminal may be proportional to the user selected point along the first and second layers, at which point the first and second layers are shorted together.

In one aspect, the first and second layers comprise a force sensing resistor whereby the resistance will vary as pressure on the user selected point changes, the higher the pressure on the user selected point causing more area contact between the first and second layers. Further, the measurement of a played note may be repeated a programmed number of times to determine an accurate pitch of played note.

In one embodiment, the fingerboard comprises multiple conductive electrode planes, each plane for detecting the pitch of a note at one or more predetermined locations on the fingerboard. Two alternating electrode planes, each of the two planes being responsive to the user selected point when located at alternating frets of the fingerboard, may be provided.

According to another aspect of the invention, there is provided an electronic musical instrument for producing musical notes comprising: an electronic fingerboard for determining pitch of the note, the electronic fingerboard comprising a first layer of film, a second layer of film and a spacer member between the first and second layers of film, the first and second layers being movable relative to each other between a first inactive position in which the first and second layers are separate from each other along their respective lengths and a second active position in which the first and second layers are in contact with each other at a user selected point along their respective lengths, the pitch being determined by the resistance between the first and second layers at the user selected point.

According to another aspect of the invention, there is provided a method of playing an electronic musical instrument which produces musical notes, the method comprising: activating an onset signal sensor for sensing the initiation of a note played on the musical instrument; and applying pressure to one or more user selected points on an electronic fingerboard which determines the pitch of the note sensed by the sensor, the electronic fingerboard comprising a first layer of film, a second layer of film and a spacer member between the first and second layers of film, the first and second layers being moved relative to each other between a first inactive position in which the first and second layers are separate from each other along their respective lengths and a second active position in which the first and second layers are in contact with each other at the user selected point along their respective lengths, the pitch being determined by the resistance between the first and second layers at the user selected point.

In accordance with one aspect of the present invention, the system of the invention is an improvement to and based upon the principles of the second type of interface described above using separate sensors for pitch and onset. The onset can be realized in many different ways using magnetic, piezo-electric, hall-effect, optical or other sensors. The pitch control means of the invention, instead of using a multitude of switches in the neck, utilizes technology which can generally be described as that adapted from the principles used in computer touch-screens using resistive technology. In one embodiment of the invention, resistive sensors are used to simulate the strings. The resistance generated by the sensors is proportional to the position along the length of the sensor at which it is activated by the user. The resistive sensors are read by an analog-to-digital converter that is controlled by a micro controller such that when the player presses on the sensor, the termination length determines the resistance read so that the represented note can be activated.

This system of the invention provides, in one form thereof, a mechanism that is familiar to guitar players and musicians skilled in playing any stringed instrument. Additionally, the resistive fingerboard of the invention can be enhanced with linear raised surfaces to provide tactile feedback giving the sensors on the instrument neck a similar feel to a conventional stringed instrument. The raised surfaces can be implemented or otherwise formed on the instrument with, as examples only, printing techniques, or by adding plastic ribs along the length of the sensors, or by embossing the raised shape on the sensor material, or adding an embossed overlay layer. The raised surfaces can be included to simulate the feel of the strings as well as the feel of the frets as necessary.

The system of the invention may have has the following benefits:

(1) Pitch Detection Method

The device of the present invention does not suffer from the inherent delay of pitch detection algorithms. The resistance value of the string sensor can be read instantaneously by the controlling microprocessor.

(2) Switch Method

This switch interface is not familiar to musicians who are trained to use stringed instruments. Pressing switches is a foreign experience and requires re-training. Therefore, one aspect of the present invention may provide a similar or familiar playing experience to that of conventional stringed instruments. Furthermore, there are cost benefits of the system of the invention, since it is simpler and efficient thus potentially costing less than that for a multi-switch system. Also the ability to provide mechanical ribs or rails emulates very closely a regular stringed instrument such as a guitar and therefore provides similar tactile feedback to a string for the player.

Another aspect of the present invention is that it may use a constant current source to excite the sensors resulting in a linear response from the sensors without the requirement for providing an electrical connection to both sides of the resistive strip. There are preferably only two conductors in the sensor, namely, the conductive strip and the resistive strip. The signal is measured directly at the termination of the resistive strip. This allows for a much simpler construction of the resistive sensor. The system is also preferably configured so that the conductive silver strip is physically located above a carbon strip. The conductive strip is connected to ground potential and thus also provides some shielding to reduce noise pickup in the system.

An instrument configured and constructed in accordance with the present invention is generally played much like a conventional guitar. Notes are fingered on the neck of the guitar and the string triggers can be plucked or strummed using common guitar playing techniques.

Several modes of operation of the present invention controlled by the micro controller may also be provided that can be used to enhance the musical performance. Representative examples of such modes are described below.

The present invention also relates to an interface for controlling musical instrument synthesizers and video games. In one aspect, the present invention allows musicians familiar with stringed instruments to use their musical skill to control electronic music synthesizers. In another aspect, the present invention allows video game players familiar with rhythm based music video games to use their skills to experience real music and to integrate real music experience into video games.

The present invention also allows popular video games such as Rock Band or Guitar Hero to add a real music experience into the game where the user is participating in actual music experience as opposed to the rhythm only experience that is now provided.

Another advantage of this system is to provide to video game players a device that can be used as a game controller as well as a musical instrument. This embodiment is a bridge instrument that can be used in the video game mode as well as in the musical instrument mode allowing a smooth transition from one the other helping reduce the learning curve for first time experience with a musical instrument. For example—the user will not need to tune this instrument.

Examples of Modes of Operation

In quantized mode, the pitch is determined when the string trigger is activated. The pitch of the initial note transmitted is quantized to the closest real note (½ step) value. If the user then slides his finger along the fingerboard the adjacent note (½ step) corresponding to the new finger position will sound.

In legato mode, the pitch is determined when the string trigger is activated. The pitch of the initial note transmitted is quantized to the closest real note (½ step) value as in quantized mode. If the user then slides his finger along the fingerboard, the system will use pitch bend commands to modify the pitch of the note proportionally to the new position on the fingerboard relative to the initial onset position. This mode provides a mechanism of control similar to guitar pitch bend in which the strings are bent. This allows smooth transitions in note pitch value as well as the ability for the user to implement pitch vibrato by rocking his finger back and forth causing slight pitch modulations. This is not available in switch based systems.

In absolute mode, the pitch is determined when the string trigger is activated. The pitch of the initial note transmitted is sent according to the note+pitch bend matching the actual position of the finger on the fingerboard. This mode is more like a fretless instrument where the note sounding always corresponds to the absolute position on the fingerboard. Vibrato modulations as in the legato mode are also possible in absolute mode. This is not available in switch based systems.

Fingerboard Layout

The fingerboard layout shown in FIG. 1 is used in the present embodiment of the invention. It is scaled to substantially match the fingerboard of a conventional stringed electric guitar. Many other configurations and scales are envisioned and fall within the scope of the invention. On a conventional guitar neck, the frets are spaced proportionally to the pitch of the note generated by the fingerboard position. Due to the fact that this system is electronic, the scale can be varied so that the frets, or fret markings, can be evenly spaced on the neck and also made smaller to provide a more compact system. The translation of finger position to actual pitch generated is determined by the software using a look-up table, mathematical equation or similar means that can also be varied to accommodate tunings of different stringed musical instruments.

BRIEF DESCRIPTION OF THE DRAWINGS

FIG. 25 shows in cross section the arrangement of a fingerboard in accordance with a further aspect of the invention;

FIG. 26 shows a detail view of a membrane with a carbon printing of the fingerboard as illustrated in FIG. 25 of the drawings;

FIG. 27 shows a detail view of a double sided adhesive tape used in the fingerboard as illustrated in FIG. 25 of the drawings; and FIG. 28 shows a detail view of a PCB layer with electrode and electronic sensing components of the fingerboard as illustrated in FIG. 25 of the drawings.

DETAILED DESCRIPTION OF THE INVENTION (A) Description of Conventional Fingerboard FIG. 1 shows a conventional fingerboard assembly 10 for use with the system of the invention. In this illustrated embodiment, the top layer of the fingerboard assembly 10 has strings 12 and frets 14 that are embossed on the surface 16 of the fingerboard assembly 10, and these raised markers for the strings 12 and frets 14 provide tactile feedback to the user. The strings 12 and/or the frets 14 could be omitted from the design. The process of marking chosen for this embodiment is to emboss these features onto the top overlay or surface 16 of the fingerboard assembly 10. Other methods include silk-screening the features with durable epoxy based ink. In another embodiment, there is use of a ½ round plastic rib that is adhered along its flat end or surface along the length of the neck 18 to simulate the tactile feeling of a string 12.

FIG. 2 of the drawings shows an exploded cross section of the fingerboard assembly 10 in accordance with the invention. There is provided a top polyester film 22 and a bottom 26 polyester film 24 which are separated by an adhesive spacer 26 layer. The top film 22 is coated with strips of silver conductive ink 28 along the length under each string 12 forming the ground electrode. The bottom film layer 24 is coated in strips of resistive carbon ink 30 forming the conductive electrode. The spacer 26 creates a series of gaps 32 between the silver conductive ink 28 and the resistive carbon ink 30 so that they do not come into contact with each other in the normal resting position. When the user touches any location along the line of a string 12, the carbon resistive ink 30 comes into contact with the silver conductive ink 28 causing the resistance to be terminated at a value proportional to the location at which the fingerboard is touched. This provides a controllable resistance that represents the pitch of the musical note corresponding to the location of the user's finger on the string.

FIG. 3 shows an overview of the present embodiment of the invention. The fingerboard 40 is located along the neck 42 of the instrument giving it the look and feel of a conventional guitar 44. Piezo sensors 48 are located in the bridge 46. These sensors 48 provide the onset signal to the control electronics. These are activated when the user strums or plucks the string triggers 50.

FIG. 4 of the drawings is a block diagram of the system electronics of the present invention. Each resistive strip 62 is powered by a constant current source 60, which ensures that the response of the resistive strip 62 is linear. The voltage at the terminal on the resistive strip 62 is determined by the location along the length of the carbon strip 62 that comes into contact with the silver ground strip 66. The signal from this point is conditioned and fed into a multiplexer 68 whose input selection is controlled by the microprocessor 70. The output of the piezo sensor elements 72 are also routed to the multiplexer 68. The microprocessor 70 sequentially reads the voltage values on the resistive strips 62 as well as the string triggers 80. This data is used to determine when a note is played, how loud the note is played and the pitch of the note played. Once the software decides on the note, it can optionally send this data out via the MIDI interface 76, or in this embodiment trigger a note in the built in internal wavetable synthesizer 78.

FIG. 5 of the drawings shows a schematic representation of the resistive sensor 90 as described in the above text for FIG. 4. This figure illustrates the mechanical construction in schematic form. It can be seen that the conductive strip 66 is connected to signal ground and the resistive strip 64 is connected to the current source and the terminal 62 is fed to the analog to digital converter. When there is no activation, the voltage at the terminal 62 is pulled up to the power supply voltage. As soon as the conductive strip 66 comes into contact with the resistive strip 64, a current flows through the resistive strip 64 between the terminal 62 and the point at which it is connected to ground. The voltage generated at the terminal 62 is thus proportional to the location along the length of the two strips 64 and 66 at which they are shorted together.

In one preferred embodiment of the invention, the fret spacing for stringed musical instruments may be determined to create evenly spaced musical half-steps along the length of the neck. The distance between frets uses the just musical scale which is proportional to the 12th root of 2. This requirement results in frets at the top of the neck being very wide or further apart and frets at the bottom of the neck being narrower or closer together.

In this design, there is no requirement for any particular fret spacing and it can be entirely controlled by the system software. In accordance with the present invention, fret spacing can be custom designed and configured so as to provide optimal comfort for the player as well as a familiar change from wider to narrower fret spacing.

Uniform spacing is also possible using the invention, but this may be quite uncomfortable for guitar players, partly because of the familiarity with traditional instrument spacing and partly because there is a natural tendency for the musician's hand to rotate as it moves along the length of the neck simply due to the mechanics of the human body. The present invention therefore provides for a spacing that is more ergonomic and "comfortable", and allows good access to all notes over the full scale of the neck.

In one embodiment of the invention, the difference between standard fret spacing and a constant fret spacing may be split using an equation developed for this purpose.

Figure 1:
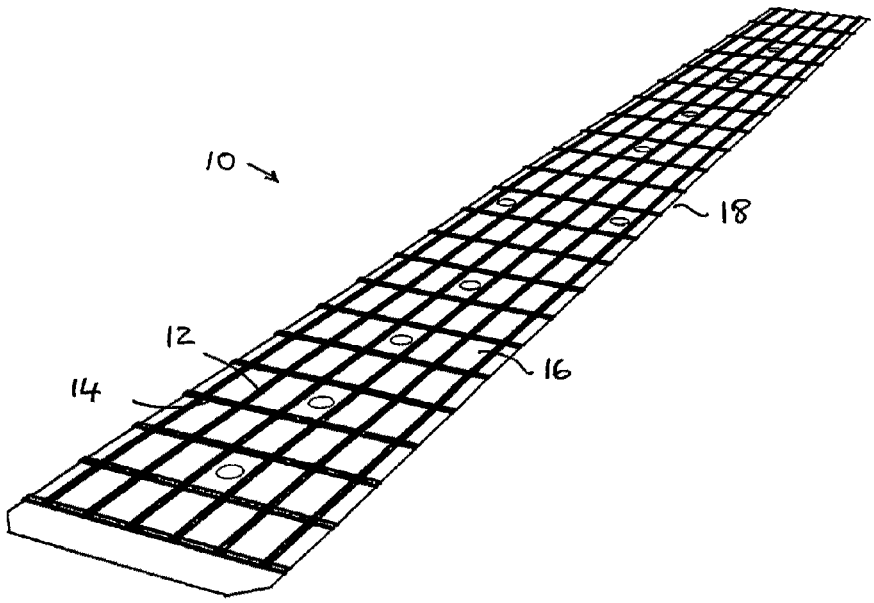
FIG. 1 is a perspective view of a typical fingerboard designed for guitar instruments.
Figure 2A:
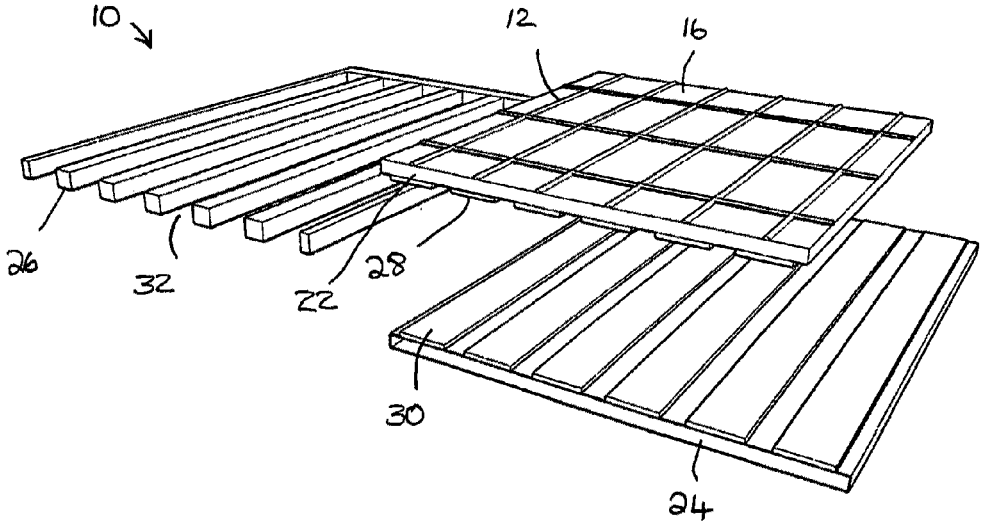
FIG. 2A is an enlarged cross section of the fingerboard shown in FIG. 1 of the drawings.
Figure 2B:
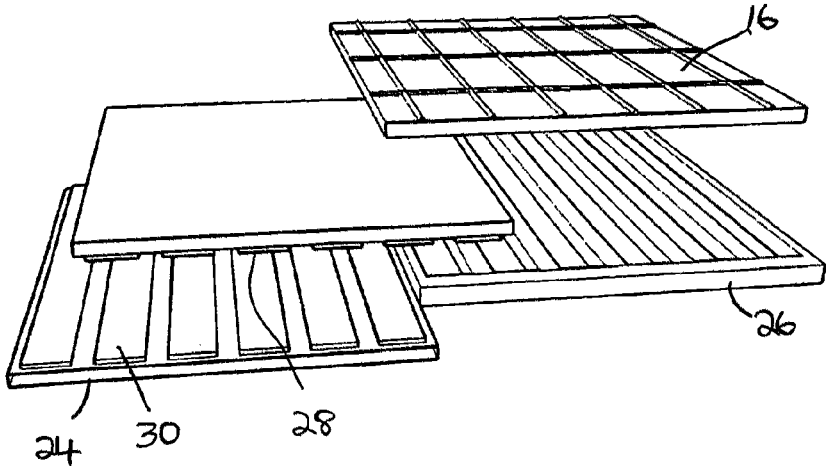
FIG. 2B is a further embodiment showing an enlarged cross section of the fingerboard shown in FIG. 1 of the drawings, but with the top section comprising two layers.
Figure 3:
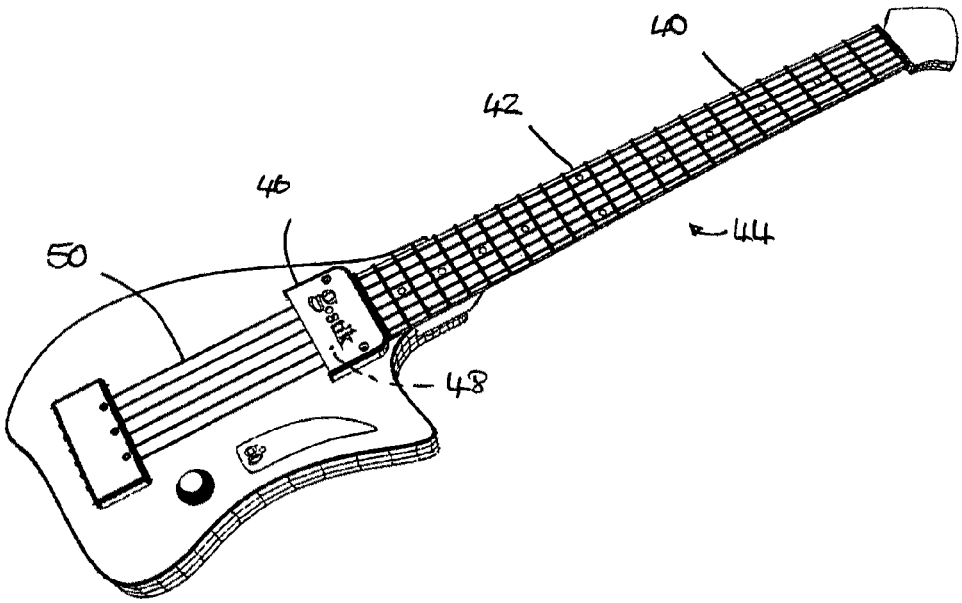
FIG. 3 is a perspective view of the complete guitar instrument.
Figure 4:
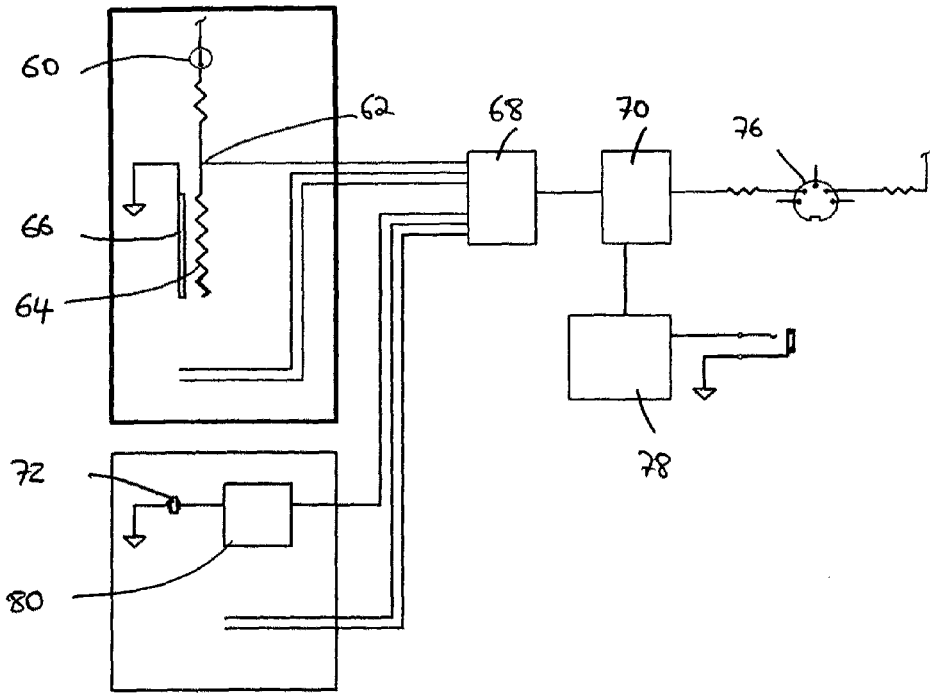
FIG. 4 is a circuit diagram of basic electronic circuitry which can be used in accordance with one embodiment of the present invention.
Figure 5:
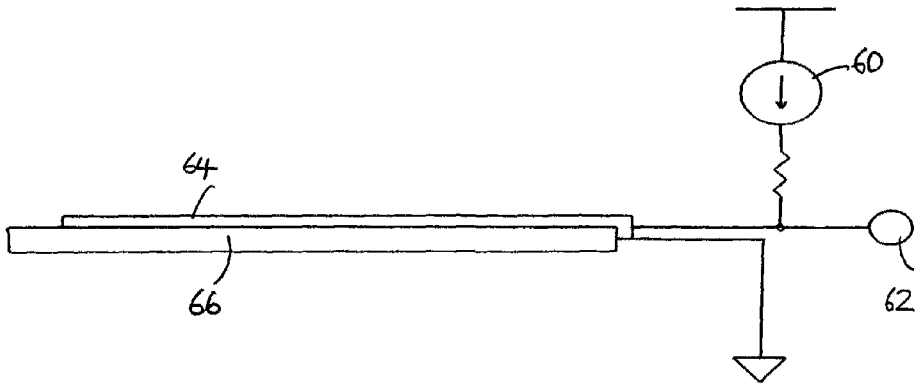
FIG. 5 is a schematic representation of the fingerboard electronics.
Figure 6:
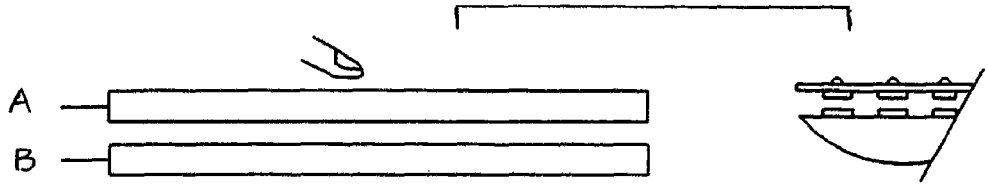
FIG. 6 is a diagrammatic representation showing pitch detection using the present invention.

With reference to FIG. 6 of the drawings, there is illustrated schematically pitch detection, effected by measuring the resistance between the upper (conductive) layer A and the lower (resistive) layer B. In FIG. 6, A represents the silver conductive strip, B represents the carbon resistive strip, the resistance representing the pitch measured between point A and point B.

Figure 7:
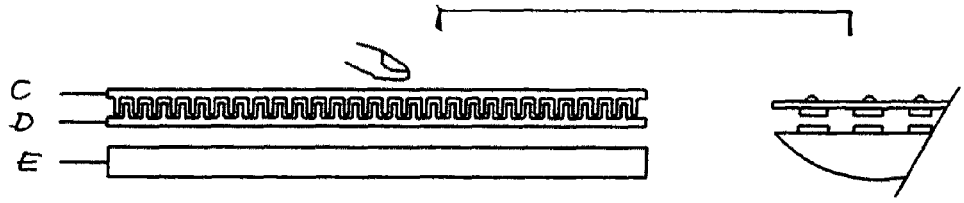
FIG. 7 is a diagrammatic representation showing pitch and pressure detection using the present invention.

In FIG. 7 of the drawings, C represents the first silver conductive strip, D represents the second silver conductive strip, while E represents the carbon resistive strip. The resistance represents the pitch measured between point C and E or D and E, and the resistance representing pressure is measured between point C and D. In FIG. 7, the pattern on the conductive silver layer is broken into two separate conductive electrodes. The electrodes have fingers that are interleaved. The resistance measurement for pitch is similar to that illustrated in FIG. 6 above. Essentially, the fact that there are two electrodes is ignored. The electronics is programmed to measure the resistance between C and E (or D and E) and in fact the measurement can even be done by shorting C and D together and measuring the resistance between the shorted silver electrodes and the carbon electrode (E).

The measurement for pressure is done by treating the device as a force sensing resistor. Point E is floated by the electronics and the measurement is done between electrodes C and D. This resistance will vary as the pressure of the user's finger causes more of the area of the electrodes to come into contact with the carbon electrode or strip E.

Figure 8:
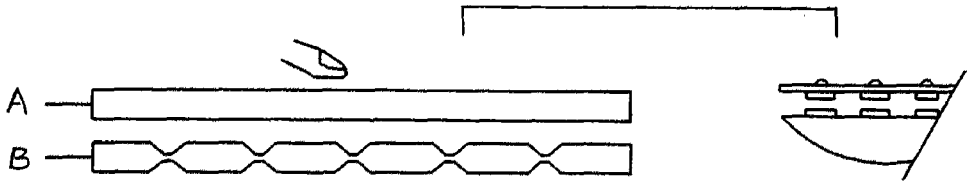
FIG. 8 is a diagrammatic representation showing stepped resistance using the present invention.

With referenced to FIG. 8 of the drawings, there is shown another embodiment of the system of the invention which utilizes a stepped shape in the resistive element. The steps occur coincidentally with the fret positions. Due to the smaller amount of resistive material deposited at the fret locations, the resistance change over these areas is much larger. This allows for greater discrimination between adjacent notes on the fingerboard.

One preferred response produced by the invention when changing from rest (no touch) to activated (touched) is that the measurement is instantaneous. In real situations, the measured value may vary slightly at the onset or release of the mechanism. Usually a simple quality measurement can be obtained by repeating the measurement and counting the number of repeated samples that fall within a pre-defined range. When the number of repeats is greater than a preset threshold, the measurement is determined to be valid. If the number of repeats could be made arbitrarily long, the system would always be accurate. For practical reasons the number of repeated samples must be limited so that the system responds in a timely fashion.

Error conditions may occur when the user does not keep constant pressure on the fingerboard. There are a few cases when this is particularly apparent:

(a) When a musician is holding a multi-note chord. Towards the end of the chord, the musician will start to reduce pressure on the fingerboard in a non-controlled manner.

(b) If a musician is playing very soft subtle notes, he may not apply good consistent pressure to the fingerboard.

Under these conditions the system may report an error, usually a lower measurement value than expected based on the fret position.

If an event is not executed by the player with precision, during the transitions as the fingerboard makes and breaks contact there can be measurements that are read as lower values than the desired value. This error is usually small, and typically is of a value that is within the range of −1 half-step (i.e. one fret lower).

To maintain a quick response to fingerboard changes, it may not be possible to increase the number of measurements for too long a period of time, so some other method of determining this error condition is needed.

Figure 9:
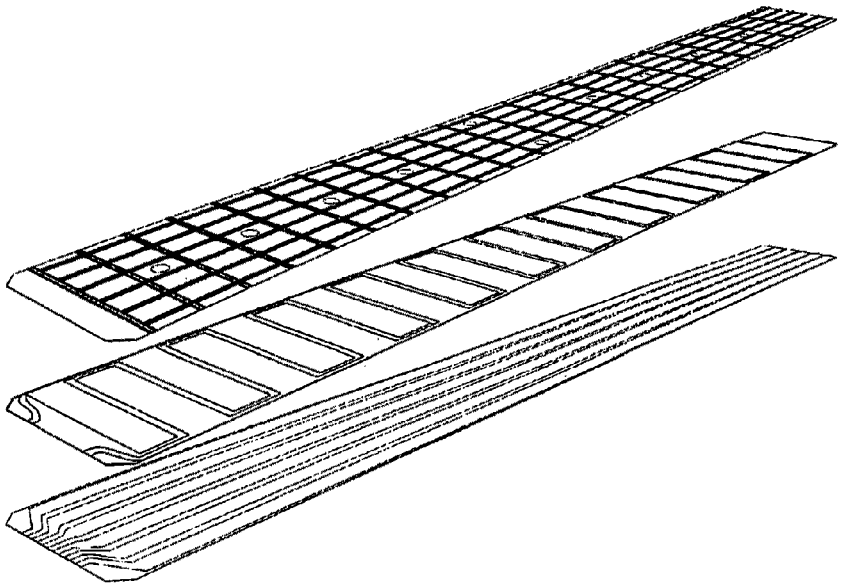
FIG. 9 is schematic perspective view of a fretboard in accordance with another aspect of the invention.
Figure 10:
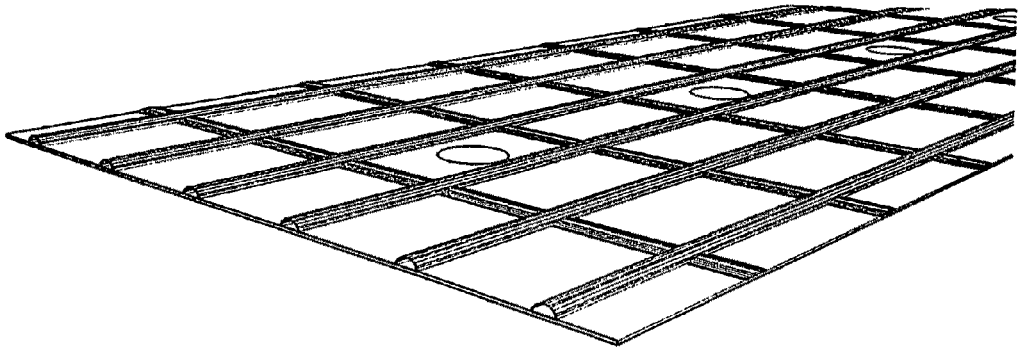
FIG. 10 is an enlarged perspective view of the top of the fingerboard showing strings in the form of raised half ribs.
Figure 11:
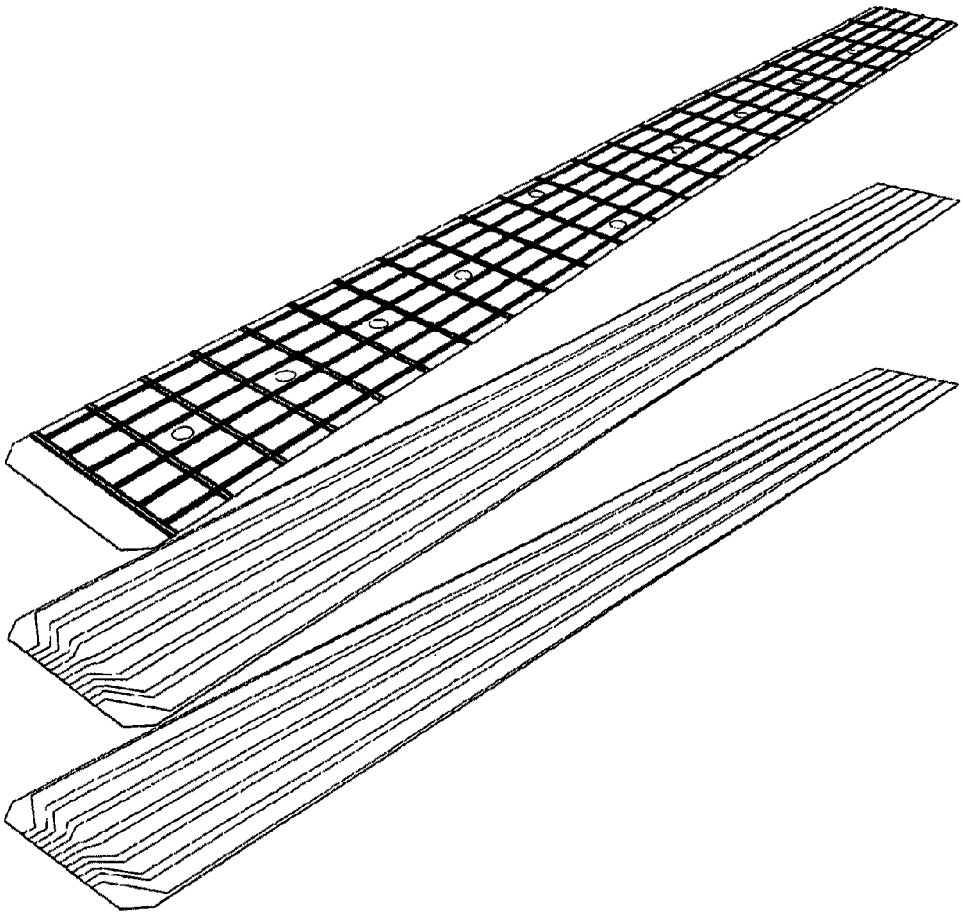
FIG. 11 is a view of the fingerboard of the invention as shown in FIG. 1 in an exploded view showing the various layer in accordance with the invention.

One solution to this situation is to configure the conductive electrode as multiple planes, effectively separating areas of the neck. For this example two separate planes are used as illustrated in FIG. 9 of the drawings. The two planes allow the separation of the scanning cycles into odd and even frets by alternately grounding and floating the planes. This allows the selective scanning of even and odd frets. When the user is pressing an even fret, say the $4^{th}$ fret, an erroneous measurement might report a note that corresponds to the $3^{rd}$ fret. However if the measurement is taken with the even plane activated, it will be known that this is an error.

The system can thus correct for these errors. For example, if one is scanning even frets and the resistance is reporting an odd fret (say $3^{rd}$ fret), it is recognized that this is an error and can safely substitute the measurement and note value that corresponds to the correct fret position ($4^{th}$ fret) for the onset of the note. The value can further be monitored by the system software as the value is corrected after the initial instability.

Note that this method can be extended for even further precision by 3, 4 or any other number of ground planes that are practical for the embodiment.

The system of the present invention is preferably based on conventional membrane switch manufacturing processes and simply has two layers (one conductor, one resistor) that are separated with an adhesive spacer. The spacer not only holds them together, but provides a consistent separation between the conductors allowing them to be activated when pressure is applied. There are no return or bridging conductors needed. All the signals are detected from the return end of the assembly.

In one form of the present invention, pressure is determined using the same set of conductors that are used to determine pitch. As such, the invention can be cost effective and thus designed for high-volume mass production. The system of the present invention can also provide individual pressure readings per string. It also uses the force sensing resistor pattern so as not to need an additional layer for pressure.

In one aspect, the invention describes an interface to MIDI synthesizer (using a conventional MIDI din jack, or USB interface to PC) or to a built in synthesizer.

The force sensing resistor pattern used in accordance with one aspect of the invention in the string sensor provides pressure sensitivity and also provides separate pressure per string. Other constructions only allow for a single pressure reading. Further, the construction of the present invention uses, in one embodiment, a separate embossed fingerboard overlaid on the switch mechanism.

The present invention is generally simple, and may use ink screening processes on two separate substrates that are assembled using an adhesive spacer. There are no "intervening conductor strips" that need to be folded, or any connecting portions. Each conductive or resistive strip is simply terminated in a connector at one end of the fingerboard where all measurements are made. As such, the present invention does not use a folded band and has signal returns at a single end of the sensor.

In one form, the invention uses piezo sensors and short strings for trigger inputs. Using a multiplexer is a standard electronic method and depends only on the hardware embodiment, namely, availability of analog to digital converter channels on the specific hardware chosen.

The invention provides for a pressure sensor based on the force sensing resistor pattern as described above. This does not require any additional layers or materials. A separate layer is used for the string tactile feeling. This may be less expensive and easier to manufacture. In one embodiment, the invention utilizes a polycarbonate overlay that is embossed with both the fret and string features. The "string-like" feel is improved with the implementation of fret features.

(B) Capacitive Sensor Method

This pitch control means of the invention utilizes technology that can generally be described as that adapted from the principles used in computer touch-screens using capacitive technology. In one embodiment of the invention, capacitive sensors are used to simulate the strings.

Capacitive sensors on the fingerboard are used to create a multitude of sensing switches on the fingerboard so that the users finger position is known. Several switches are provided for each note location. This resolution greater than a single note per fret position allows the system software to interpolate the finger position so that locations between notes can be determined and an approximation to pitch bending and musical vibrato can be implemented.

Capacitive sensors have been used for many years in elevator switches and more recently in touch screens for cellular telephones and computer displays. This implementation for musical instrument fingerboard is unique. The capacitive sensors can be created by various techniques: for example, they can be printed on a plastic/mylar substrate, or they may be formed using conventional printed circuit techniques.

This system of the invention provides, in one form thereof, a mechanism that is familiar to guitar players and musicians skilled in playing any stringed instrument. Additionally, the capacitive fingerboard of the invention can be enhanced with linear raised surfaces to provide tactile feedback giving the sensors on the instrument neck a similar feel to a conventional stringed instrument.

General Description of Capacitive Sensing System

Capacitive sensing systems take advantage of the capacitance of the human body to detect 'human' touch. The fingerboard is located along the neck of the instrument giving it the look and feel of a conventional guitar. Piezo sensors are located in the bridge 123 (see FIG. 12) and these sensors provide the onset signal to the control electronics. These are activated when the user strums or plucks the string triggers 124.

Figure 13:
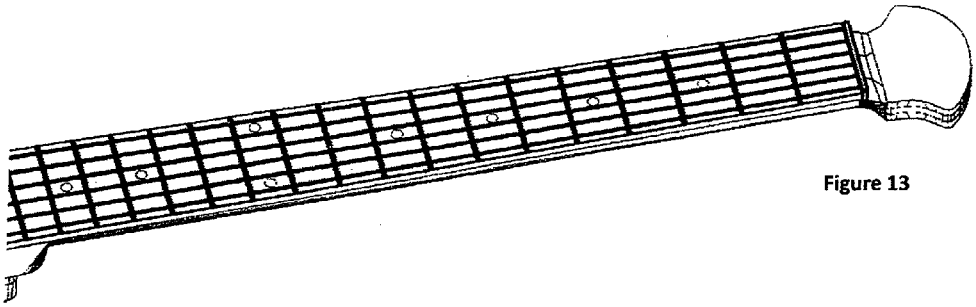
FIG. 13 shows a close view of the neck of the instrument illustrating the raised fret and string embossed sections which provide tactile feel to the user.
Figure 14:
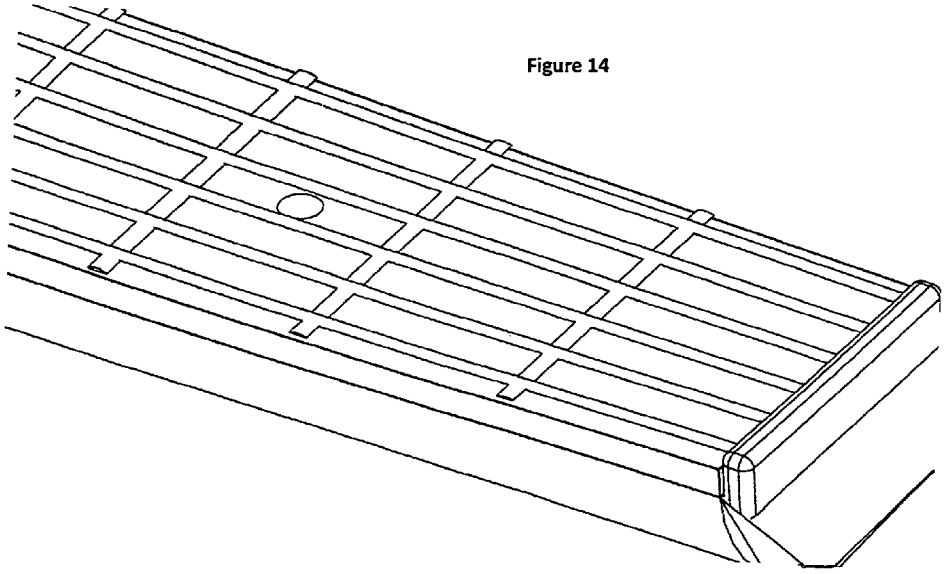
FIG. 14 shows a closer view of the raised frets and strings embossed onto polycarbonate material.

FIG. 13 is a detail of the neck showing the fret and string markings on a polycarbonate overlay. FIG. 14 shows the raised frets and strings embossed onto a polycarbonate material.

Figure 15:
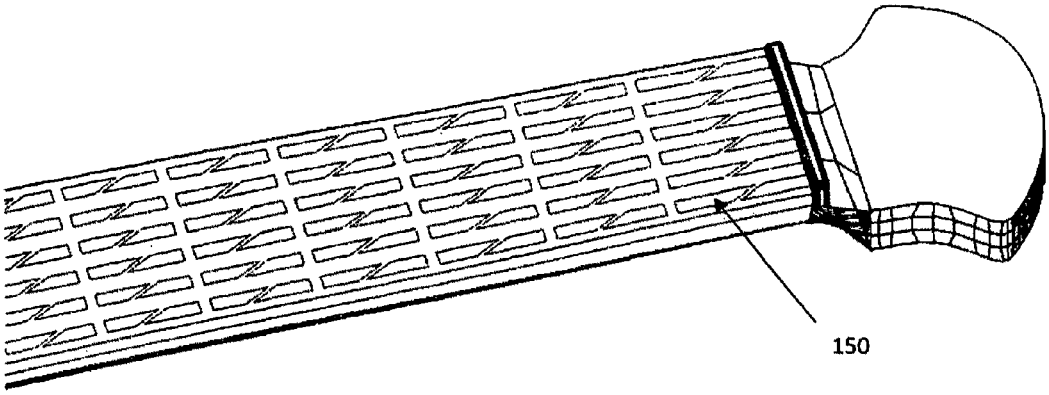
FIG. 15 shows one embodiment of the capacitive or discrete sensor elements on the fingerboard.

FIG. 15 shows one embodiment of the capacitive sensor elements. In this embodiment, there are two capacitive elements 150 per note position. This allows additional finger position information to be read so that musical effects such as pitch bend and vibrato can be sensed from the system. The capacitive sensors are conductive electrodes that can be manufactured using various low-cost processes. In this embodiment, conventional printed circuit board manufacturing techniques are used. The electrodes are etched in a standard copper clad printed circuit board, and the connections to the control electronics is made on the bottom side of the printed circuit board. Other methods may be employed including printing electrodes using silver and carbon ink on a mylar substrate or flexible printed circuit board.

Figure 16:
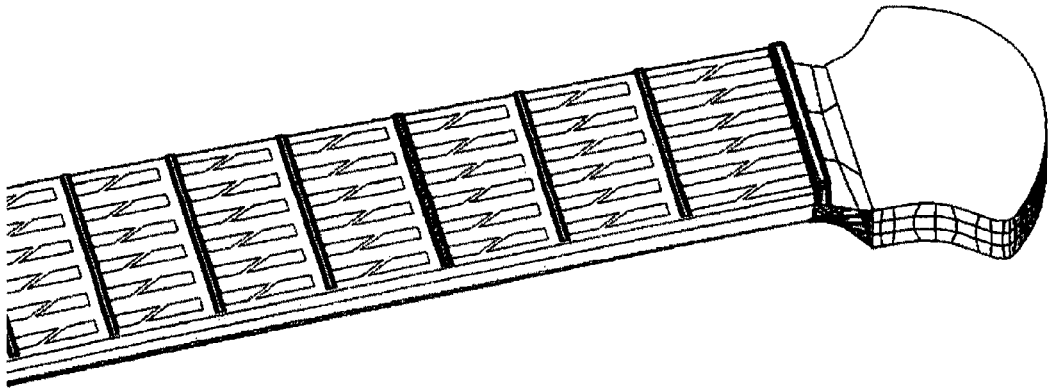
FIG. 16 shows the location of the sensors relative to the fret positions.

FIG. 16 shows the capacitive sensor elements relative to the fret position markings. A gap in the sensor between fret positions ensures correct fret location activation.

Figure 17:
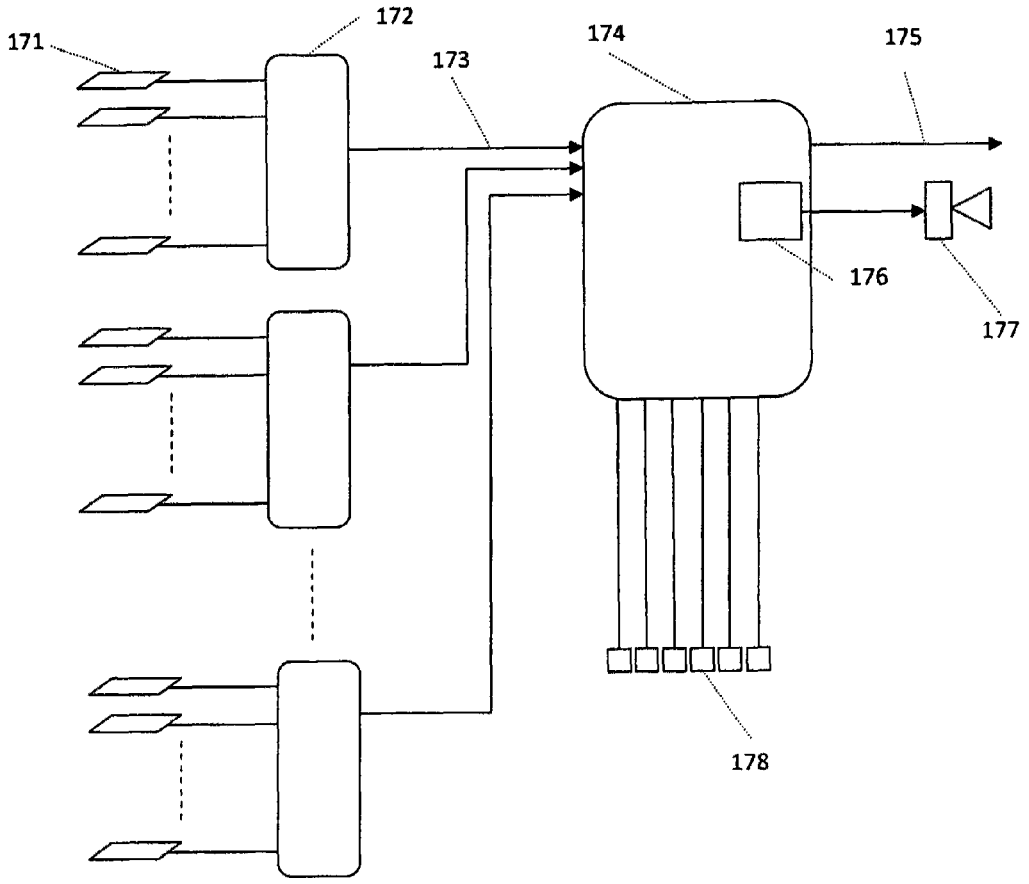
FIG. 17 shows a block diagram of the system electronics for the capacitive sensor system.

FIG. 17 is a block diagram of the system electronics of one aspect of the present invention. In this embodiment, two capacitive sensors are used per fret on the instrument. This means that for a guitar with 22 frets and 6 strings, there are a total of 22×2×6=264 sensors. In this embodiment, small microcontrollers 172 are used for the individual sensors. Each microcontroller 172 can support up to 24 sensors, so there are a total of 11 microcontrollers required. The small microcontrollers 172 are all connected via a serial communications link 173 to the main controller 174. This main microcontroller 174 takes all the sensor information and converts the data to note information. This note information is then either transferred to the internal synthesizer or an external MIDI or USB synthesizer.

(C) Discrete Sensor Method

In accordance with another aspect of the present invention, this system of the invention is an improvement to and based upon the principles of the second type of interface described above using separate sensors for pitch and onset. The onset can be realized in many different ways using magnetic, piezoelectric, hall-effect or other sensors. In one embodiment of the invention, the discrete membrane sensors are used to simulate the strings.

Discrete sensors on the fingerboard are used to create a multitude of sensing locations on the fingerboard so that a user's finger position is known. Several sensor locations can be provided for each note location. This gives a resolution greater than a single note, allowing the system software to interpolate the finger position so that information between notes is determined so that an approximation to pitch bending and musical vibrato can be implemented.

The system of the invention in one aspect uses a sensor system based on an array of discrete contact elements consisting of a substrate with sensor patterns, a contact membrane and a tactile overlay. The substrate can be constructed using a printed circuit board using standard fiberglass construction or a flexible circuit board. Contact patterns for the sensor electrodes are on the top side of the printed circuit board. On the bottom side of the substrate are integrated circuits that are used to detect sensor activations. Each sensor electrode is connected to an input on one of a multitude of these integrated circuits.

There are three main parts to the discrete-sensor fingerboard: the substrate 180 (see FIG. 18) with the sensor patterns, the common contact membrane 181 and the tactile overlay 182.

In this embodiment, the substrate 180 is constructed using a printed circuit board using standard fiberglass construction or a flexible circuit board. Contact patterns for the sensor electrodes are etched on the top side of the printed circuit board. On the bottom side of the substrate integrated circuits that are used to detect sensor activations are mounted. Each sensor electrode is connected to an input on one of a multitude of these integrated circuits.

The contact membrane is typically connected to ground potential and is constructed as a solid or as shown in this embodiment 181 as 6 separate ground traces that can be terminated to a common ground signal. The overlay 182 provides the user with the tactile feel of a stringed guitar-like instrument. In this embodiment, it is an embossed polycarbonate material.

The integrated circuits used to detect the activations are mounted on the bottom side of the substrate. These devices convert the state of their inputs to a serial output data stream that can be read by a host microcontroller. Each device includes a weak pull up resistor on its input, so that the "resting" signal on the input is seen as a high level (or a 1). When the user activates the sensor by pressing the contact membrane so that the ground potential on the common membrane comes in to contact with one of the discrete sensor elements on the top side of the printed circuit board, the voltage on the input circuit for that sensor is forced to ground level (or 0).

A guitar fingerboard requires a large amount of sensors, in this case 22 per string for a total of 132. In this embodiment, IC's that can support up to 24 inputs per IC are used so a total of IC's are needed. A host microcontroller 193 (FIG. 19) is connected to these sensor IC's over a serial communications interface. The host microcontroller interrogates the state of the sensors by transferring the data over the serial communications interface. The host microcontroller then uses the sensor states to determine the location that the user is activating on the fingerboard which is further translated into MIDI note information or sound from the internal wavetable synthesizer.

FIG. 15 shows one embodiment of the discrete sensor elements. In this embodiment, there are two sensor elements per note position 150. This allows additional finger position information to be read so that musical effects such as pitch bend and vibrato can be sensed from the system. The discrete sensors are conductive electrodes that can be manufactured using various processes. The electrodes are etched in a standard copper clad printed circuit board, and the connections to the control electronics are made on the bottom side of the printed circuit board. Other methods may be employed including printing electrodes using silver and carbon ink on a mylar substrate or flexible printed circuit board.

Figure 18:
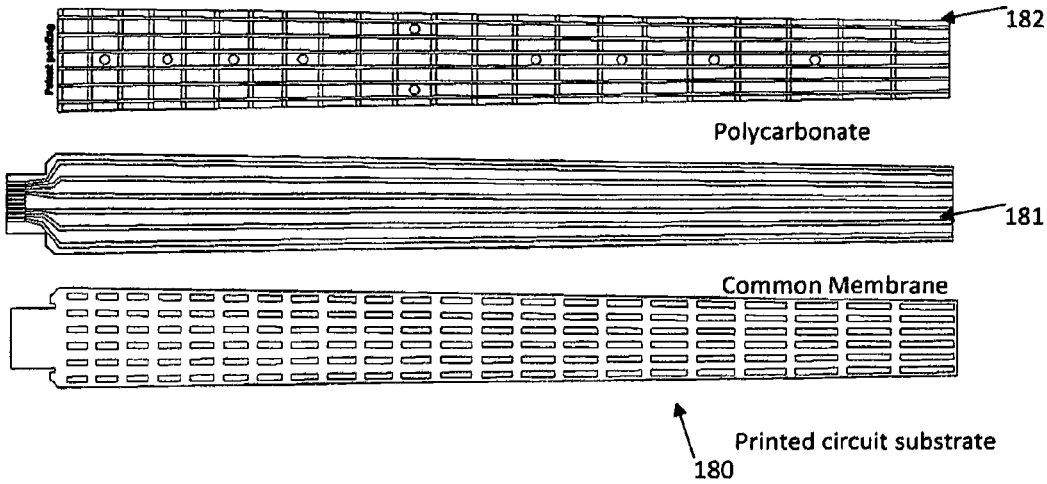
FIG. 18 shows the material layers used in the construction of the discrete fingerboard.

FIG. 16 shows the discrete sensor elements relative to the fret positions. FIG. 18 shows the construction of the fingerboard made up of three layers the polycarbonate overlay (182), the common membrane (181), the Printed Circuit board Substrate (180).

In this embodiment, the substrate is fabricated using conventional printed circuit board manufacturing techniques. The contact pattern for the sensing elements 180 are etched in the top layer of the substrate. There are several integrated circuits mounted on the rear of the substrate. These devices provide inputs that can be used to determine the voltage state of the input sensors. Each sensing element (180 and 191) is connected to a separate input on a multitude of these devices. The devices have integrated pull up resistors on each input. When the system is at rest, the pull-up resistor causes the signal read by the integrated circuit to be at a high (or 1) logic level. The system is activated by the user pressing on the polycarbonate overlay which causes the common (or grounded) (199) membrane to come into contact with the sensor element at the location that the user has pressed causing a low (or 0) logic level.

A host microcontroller (193) then reads the signals from the sensor IC's and determines the state of each of the guitar fret positions.

Figure 19:
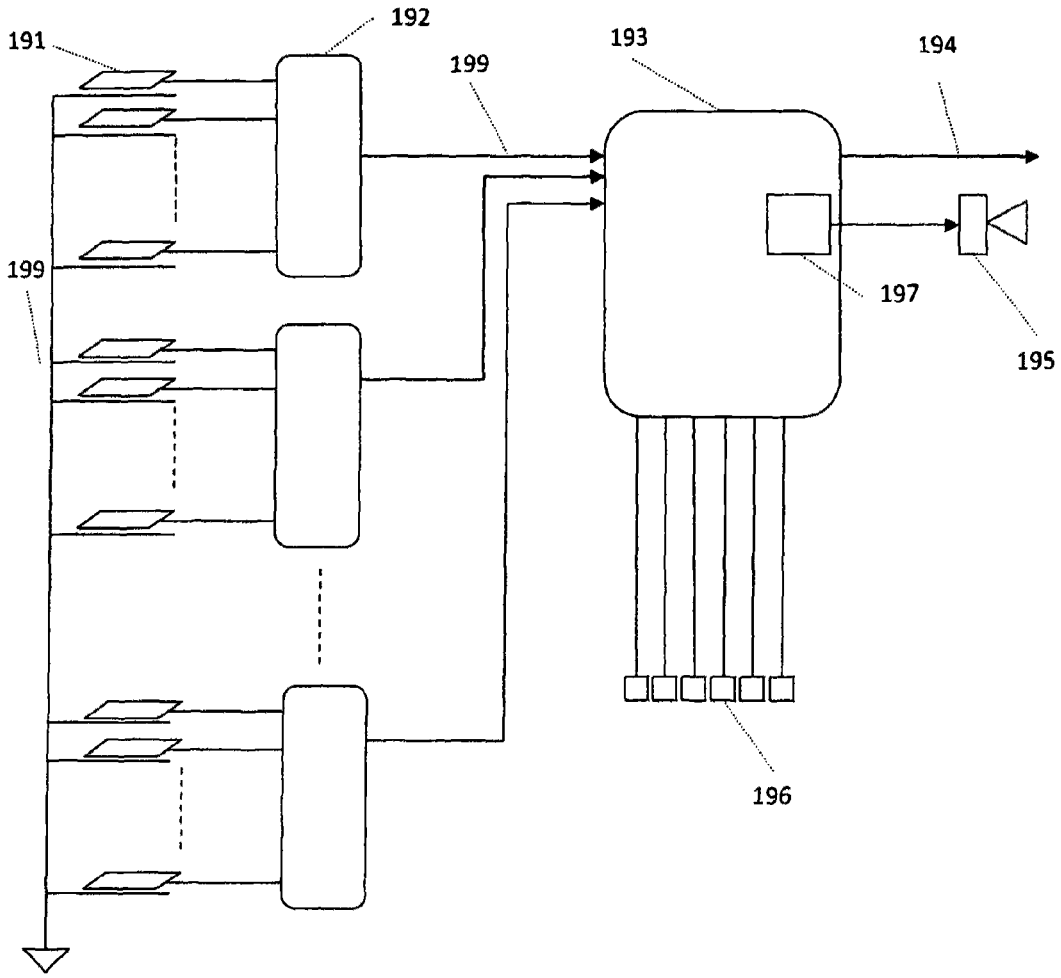
FIG. 19 shows a block diagram of the system electronics for the discrete fingerboard system.

FIG. 19 is a block diagram of the system electronics of the discrete sensor embodiment of the present invention. In this embodiment, a single sensor is used per fret position on the instrument (this could be expanded to multiple positions to increase the resolution). This means that for a guitar with 22 frets and 6 strings, there are a total of 22×6=132 sensors. In this embodiment, input expander integrated circuits 192 are used. Each input device can support up to 24 sensors, so there 9 are a total of 6 devices required. These devices are all connected via a serial communications link 199 to the main microcontroller 193.

The main microcontroller 193 takes all the sensor information and converts the data to note information. This note information is then either transferred to the internal synthesizer or an external MIDI or USB synthesizer.

The output of the piezo sensor elements 196 are also routed to the microcontroller 193. The micro controller reads the values from the sensors and the string triggers. This data is used to determine when a note is played, how loud the note is played and the pitch of the note played. Once the software decides on the note, it can optionally send this data via the MIDI interface 194, or in one embodiment trigger a note in the built-in internal wavetable synthesizer (197).

(D) Multi-Touch Capability

It is one aspect of this invention to also provide a control interface for popular video games (such as Rock Band and Guitar Hero). These games allow individuals with no musical ability (or even some with musical ability) to participate in a music related game. This is accomplished using these popular video games and allowing the user to respond to rhythm information on the video game screen to simulate a musical instrument playing experience. It is an aspect of the invention to provide an instrument that is a bridge between the non-musical video games and a real musical instrument. The instrument provides a video game player with the dual function of playing the video game and playing real music on the same instrument. The familiarity with the instrument and the fact that it does not need to be tuned makes it easier for a video game player to migrate to a real musical experience. This new interface for video games also will allow video game developers to increase the complexity of the video games to integrate a real musical experience into the game.

The multi-touch feature preferably allows the device to serve as a video game controller as well as a musical instrument. In the embodiment of the invention described herein, the fingerboard has two distinct features, the first as a controller for guitar or bass guitar video games and the second as a guitar-like musical. This system is intended to provide an easy migration path for video game players familiar with the buttons of a video game controller used to simulate a musical experience, to a realistic musical instrument experience.

Standard stringed musical instruments cannot be used as video game controllers for guitar based video games like Guitar Hero™ or Rock Band™ because of the need to activate more than one location on a single string. The multi-touch fingerboard addresses this problem, allowing the fingerboard to be used as both a game controller and a musical instrument.

It has been reported that a high percentage of rhythm based guitar video game players want to learn to play a real musical instrument. But when faced with a real musical instrument the learning curve is overwhelming. This invention preferably simplifies the transition by overcoming the tuning requirement and providing a familiar device.

Standard stringed instruments have a significant learning curve to achieve proficiency. This instrument overcomes several of the difficulties faced by a video game player desiring to learn a musical instrument. Conventional stringed instruments require tuning, whereas the invention described here may not need tuning. Conventional stringed instruments are very different from the conventional controllers used to play video games. The device described in this invention is a "bridge" instrument and is used for both controlling the video games and playing music as a guitar. A conventional stringed instrument requires musical training, the invention described includes features that can be configured to always play in tune using software and knowledge of the musical key of accompaniment pieces—so the user has a much shorter learning curve to achieve a meaningful musical experience.

The capacitive and discrete embodiments of this invention provide discrete sensors for every position on the fingerboard and thus allow for the full implementation of the multi-touch requirement for video games as well as the musical instrument.

Advantages of this invention over conventional stringed musical instruments may principally be that it does not need to be tuned as with standard stringed musical instruments and that the design and manufacturing allows for a low-cost entry level musical instrument.

This invention adds multi-touch features that allow the control of guitar oriented video games. In a typical guitar game controller, 5 buttons are provided. These buttons are laid out on the guitar fingerboard to simulate fret positions. On a standard string instrument or MIDI guitar, multiple fret positions cannot be activated on a single string because the sensor system will only pick up the signal derived from the length of the string to its shortest termination. For guitar like video game controllers, it is important to be able to detect multiple fret activations on a single string to respond to features of the game that require multiple buttons to be pressed at once.

An instrument configured and constructed in accordance with the present invention may have two modes of operation: The first is Guitar Mode in which the instrument is generally played much like a conventional guitar. Notes are fingered on the neck of the guitar and the string triggers can be plucked or strummed using common guitar playing techniques. The second is Game Mode in which the instrument is played much like a video game controller for music based video games.

(E) Multi-Touch With The Resistive Fingerboard

Multi-Touch capability increases the flexibility of the previously described resistive fingerboard.

Figure 12:
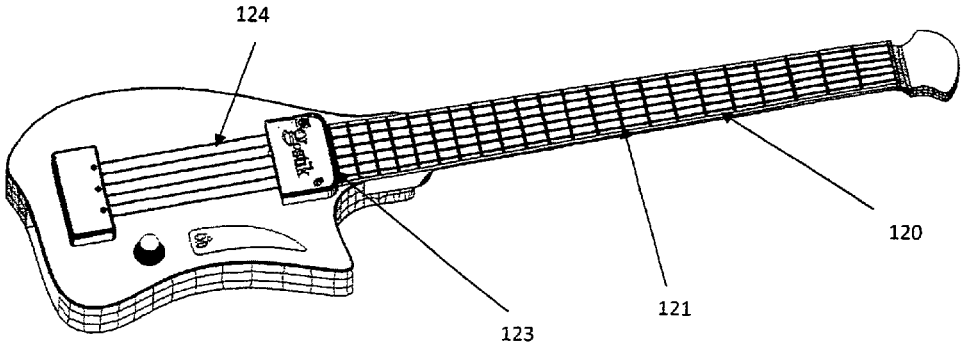
FIG. 12 shows a complete system with fingerboard.

FIG. 12 shows a complete instrument assembly (a guitar in this case). In this embodiment, the top layer of the fingerboard assembly has markers for strings 120 and for frets 121. These markers provide tactile feedback to the user similar to that of a conventional guitar. The strings and/or the frets could be omitted from the design. The process of marking chosen for this embodiment is to emboss the features on to a polycarbonate substrate. In other embodiments these features can be silkscreened onto the top layer of the fingerboard with durable epoxy based ink. In another embodiment a ½ round plastic rib is adhered along its flat end or surface along the length of the neck to simulate the tactile feeling of a string.

Figure 24:
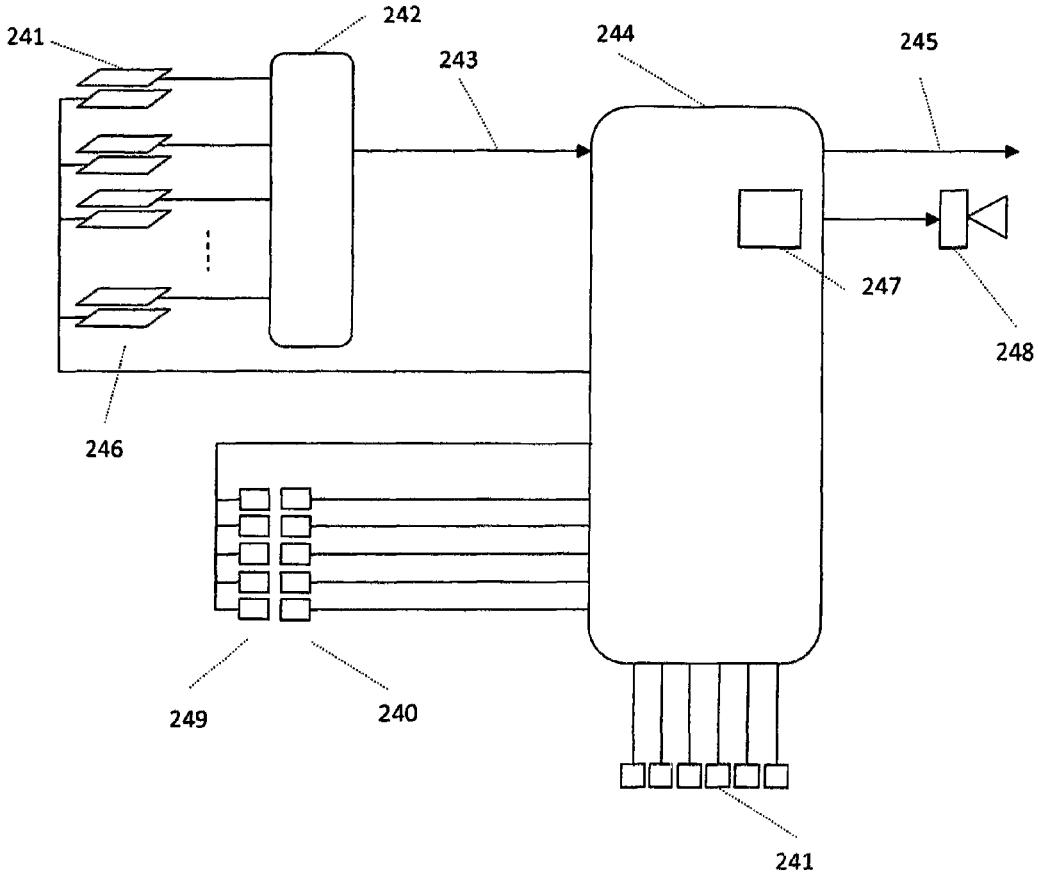
FIG. 24 shows a block diagram of the system electronics for the Multi Touch System.

The fingerboard is located along the length of the neck of the instrument giving it the look and feel of a conventional guitar, the fingerboard provides touch location information back to the control microprocessor 244 (FIG. 24). Piezo sensors are located in the bridge 123, and these sensors provide the onset signal to the control electronics which are activated when the user strums or plucks the string triggers 124.

Figure 20:
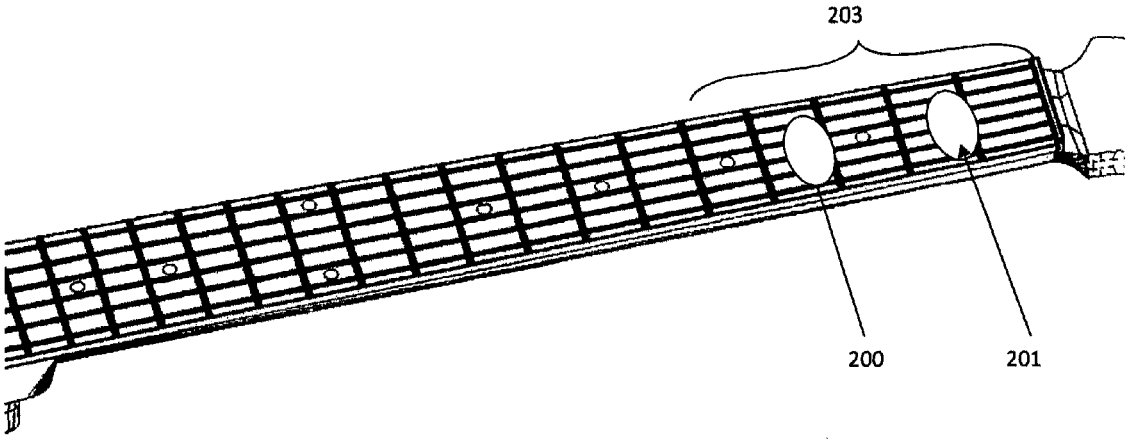
FIG. 20 shows a close view of the neck of the instrument illustrating example game mode fret locations and the raised fret and string embossed sections which provide tactile feel to the user.

FIG. 20 shows a detail view of the neck of the instrument region 203 and illustrates the first five fret locations that can be used to control a video game. In addition to the sensors that provide pitch information to the control microprocessor by pressing along the length of the simulated strings, switches are embedded in the fingerboard to allow the control of video games. For example the first 5 fret locations 203 on the neck each activate a distinct game switch. These switches can be activated by pressing anywhere in the area defined by the frets; in one case, the area between the nut and fret 1 will activate switch 1, the area between fret 1 and fret 2 will activate switch 2 and so on. So when the user presses anywhere on the second position in the area illustrated by area 201 the video game control switch corresponding to switch 2 will trigger. When the user presses anywhere on the position illustrated by area 200, the video game control switch corresponding to switch 4 will trigger. The switch mechanism can be constructed so that the five video games switches can be located sequentially anywhere on the neck to suit different sized users hands.

Figure 21:
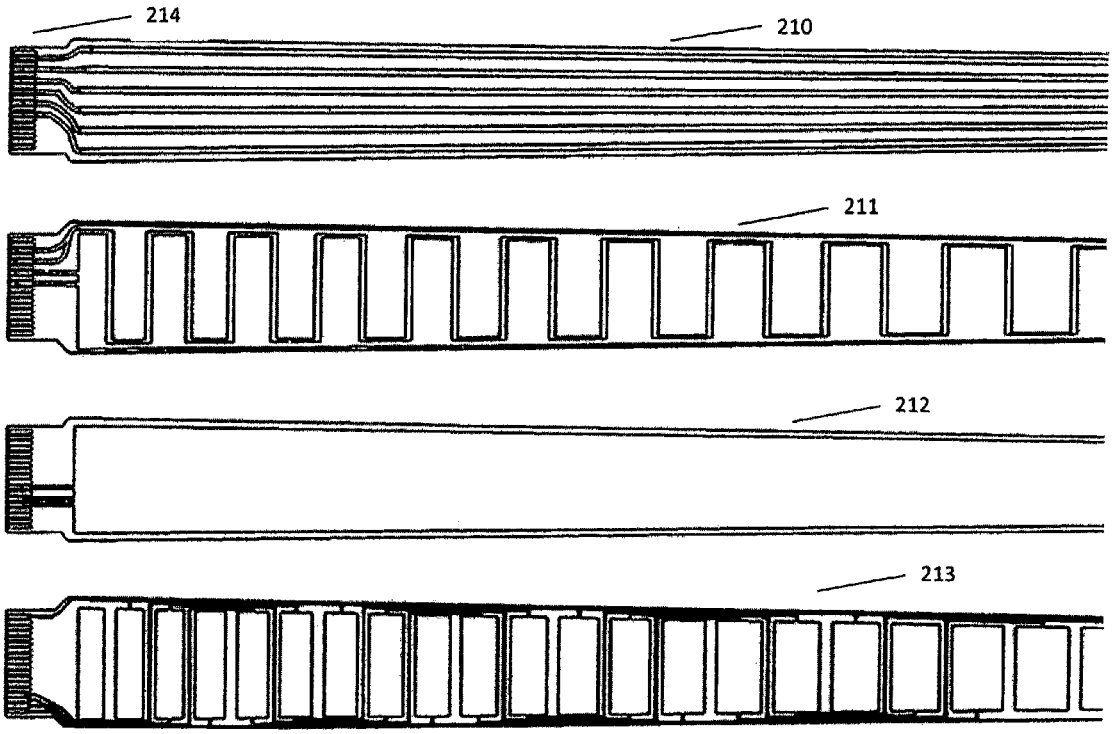
FIG. 21 shows the individual layer patterns of one embodiment of the multi-touch resistive fingerboard.

FIG. 21 of the drawings shows details of the individual layers of an embodiment of the multi-touch switch in accordance with the invention. In one embodiment of the invention, the electrodes of the switch are printed on four polyester films. The underside of the upper polyester film 210 is coated with strips of resistive carbon ink along the length of each string. The top side of the second polyester film 211 is coated with a low resistance ink such as conductive silver ink covered in carbon ink in a pattern that forms two alternating ground planes. The underside of the third polyester film 212 is coated with low resistance carbon to form a single conductive ground plane. The topside of the bottom polyester film 213 is coated with low resistance carbon to form five groups of switches with an individual switch located at each fret position.

Figure 22:
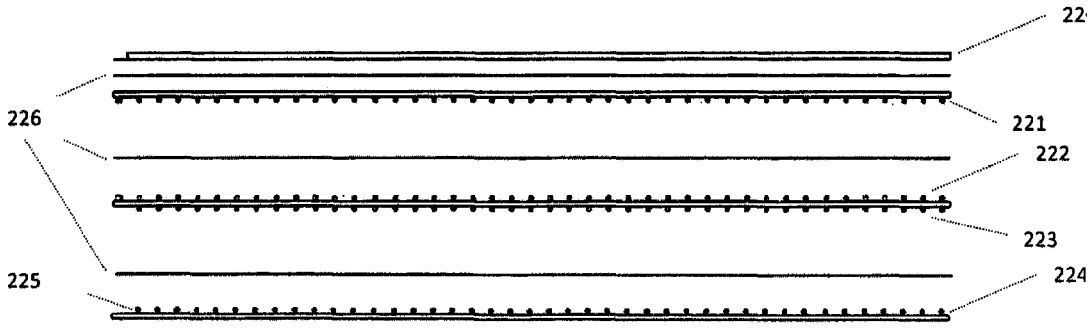
FIG. 22 shows the layer stack up arrangement of one embodiment of the multi-touch resistive fingerboard.

FIG. 22 illustrates how the polycarbonate overlay 220 and the polyester films are assembled. Adhesive spacer material is provided between each layer. This spacer material holds the layers together and also provides a gap between the individual layers so that they do not come into contact when in the rest position. Additionally spacer dots 225 can be used to keep the layers apart when at rest.

Figure 23:
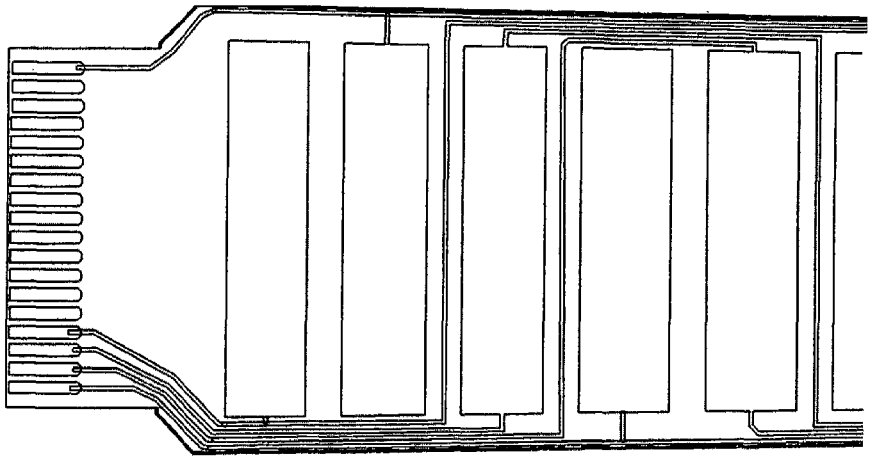
FIG. 23 shows a detail view of a section of the 5-way switch electrodes.

FIG. 23 shows a detail view of the topside of the bottom polyester film. Electrode surfaces are located at each fret position. In this embodiment, the electrodes are connected in groups of five so that the five game switches can be located at any position on the fingerboard to accommodate for different sized user hands.

FIG. 24 of the drawings is a block diagram of the system electronics for the resistive multi-touch embodiment of the present invention.

In Guitar Mode, each resistive strip 210 is powered by a constant current source, which ensures that the response of the resistive strip is linear. The voltage at the terminal on the resistive strip 214 is determined by the location along the length of the carbon strip that comes into contact with the ground 211. The signal from this point is conditioned and fed into a multiplexer 242 whose input selection is controlled by the microprocessor 244. The output of the piezo sensor elements 241 are also routed to the microprocessor 244. The microprocessor 244 sequentially reads the voltage values on the resistive strips as well as the string triggers. This data is used to determine when a note is played, how loud the note is played and the pitch of the note played. Once the software decides on the note, it can optionally send this data out via the MIDI interface 245, or in this embodiment trigger a note in the built in internal wavetable synthesizer.

In Game mode, the switch matrix is formed by the common plane 212, 249 and the five switch electrodes 213, 240. In this mode, the microprocessor 244 simply scans for which of the electrodes are in contact with the common plane. This switch information is then transmitted by the microprocessor to the video game hardware.

The system of the present invention is preferably based on conventional membrane switch manufacturing processes and simply has four layers that are separated with an adhesive spacer. The spacer not only holds them together, but provides a consistent separation between the conductors allowing them to be activated when pressure is applied. All the signals are detected from the return end of the assembly.

Alternative Neck and Fingerboard Design

Reference is now made to FIGS. 25 to 28 of the drawings which show an alternative neck and fingerboard design in accordance with a further aspect of the invention.

As an alternative to the construction of a continuous resistive sensing mechanism, another form of the invention provides for a discrete sensor mechanism with an individual/discrete sensing point for every note position. This may be accomplished by using an overlay that has a continuous string feature made of silicone rubber with a non-friction coating thereon. This string feature provides a good tactile response that may "feel" more like a conventional guitar. The discrete sensing points allow a very accurate detection of the user's position on the fingerboard. In this way, it is possible to simulate the continuous nature of guitar playing by interpolating intermediate notes if the user slides up or down the neck of the guitar. There may also be provided a whammy bar (pitch bend) that allows the user to selectively bend notes continuously.

This embodiment of the fingerboard design is preferably for to optimizing sensitivity to the user's touch. Other embodiments of the invention described herein have used a polymer overlay, which may be comprised more specifically of polycarbonate. This embodiment of the invention which uses the silicone rubber material for the tactile interface offers the alternative of a much less rigid surface and may result in a more responsive fingerboard. For this reason, this form of the invention may be one which is therefore much easier for many musicians to play as a musical instrument.

The construction of this embodiment of the invention is in fact very similar to those described in other embodiments above, with the major change being from the use of polycarbonate to the more flexible silicone rubber overlay.

Overlay Construction

The construction and order of the layers are as follows, from the tope layer working downwards:

1. a PU (Polyurethane) overspray non-stick coating 300;
2. a clear silicon rubber overlay 302 which is painted on the rear;
3. a double side adhesive tape 304, which may in one example only have a thickness of about 0.08 mm;
4. a PET (Polyethylene terephthalate) membrane 306 with a carbon printing 308 on the rear and which may in one example have a thickness of about 0.125 mm;
5. a double sided adhesive tape 310 which in one example may have a thickness of about 0.08 mm, and which may be die cut with windows for the carbon printing 308;
6. a PCB 312 with contact electrodes and electronic sensing components.

The PU overspray 300 helps to remove or reduce the friction or tacky feel which may be present on the silicon rubber. This is preferably comprised of a durable baked coating.

The silicone rubber 302 is molded so as to incorporate the string and fret features and construction. This provides a comfortable tactile interface to the user. The rubber 302 is also very flexible and transmits the user's touch directly to the carbon switch mechanism. The silicone rubber 302 is clear and is painted on the rear to emphasize the string, fret and dot features that are familiar to guitar players.

The double side adhesive tape 304 is simply to bond the silicone to the PET. The PET 306 provides a substrate layer for the carbon conductors 308 that are printed on the rear thereof.

The double sided adhesive tape 310 layer is die cut with cutouts that expose the carbon 308 on the PET 306 to the contacts on the PCB 312 below. This layer of tape 310 provides the critical separation that ensures that the switches respond and release reliably.

The switches are formed by the contacts that are etched in the PCB being shorted by the carbon 308 on the PET 306 layer.

FIG. 26 is a detail view of the carbon printing on the PET in accordance with the embodiment illustrated in FIG. 25 of the drawings. FIG. 27 shows a detail of the double sided adhesive tape with the contact pattern die cut out of it. FIG. 28 shows a detail view of the PCB layer.

The invention claimed is:

1. An electronic fingerboard for use on a musical instrument, the electronic fingerboard comprising:

a printed circuit board layer with contact electrodes and electronic sensing components;

a first double sided adhesive tape over the printed circuit board layer including die cut windows;

a polyethylene terephthalate (PET) membrane above the first double sided adhesive tape, the PET membrane having carbon printing on the lower surface thereof, at least a part of which are accommodated in the windows;

a second double sided adhesive tape above the PET membrane;

a silicon rubber overlay mounted over the second double sided adhesive layer; and a polyurethane overspray comprising a non-stick coating formed on the silicon rubber overlay.

2. An electronic fingerboard as claimed in claim 1 wherein the printed circuit board comprises discrete sensor elements.

3. An electronic fingerboard as claimed in claim 2 wherein pitch is determined by the location of the discrete sensors on the printed circuit board.

4. An electronic fingerboard as claimed in claim 1 wherein the musical instrument is an electronic guitar comprising longitudinal strings and transverse frets formed by linear raised rib surfaces to provide tactile feedback and feel similar to a conventional stringed instrument.

5. An electronic fingerboard for use on a musical instrument, the electronic fingerboard comprising:

a printed circuit board layer with contact electrodes and electronic sensing components;

a first double sided adhesive tape over the printed circuit board layer including die cut windows;

a polyester film membrane above the first double sided adhesive tape, the polyester film membrane having carbon printing on the lower surface thereof, at least a part of which is accommodated in the windows;

a second double sided adhesive tape above the polyester film membrane;

a silicon rubber overlay mounted over the second double sided adhesive layer; and a polyurethane overspray comprising a non-stick coating formed on the silicon rubber overlay.

* * * * *